United States Patent [19]

Bunch, III

[11] Patent Number: 5,015,222

[45] Date of Patent: May 14, 1991

[54] SPIRAL PAPER FOLDING MACHINE WITH AUTOMATIC CHANGE GEAR ADJUSTMENT

[75] Inventor: Earnest B. Bunch, III, Glendale, Ariz.

[73] Assignee: B. Bunch Company, Inc., Phoenix, Ariz.

[21] Appl. No.: 462,766

[22] Filed: Jan. 10, 1989

[51] Int. Cl.[5] ..... B65H 45/105

[52] U.S. Cl. ..... 493/11; 493/13; 493/23; 493/24; 493/28; 493/29; 493/413; 493/414

[58] Field of Search ..... 493/8, 10, 11, 13–15, 493/17, 18, 23, 24, 28, 29, 413, 414

[56] References Cited

U.S. PATENT DOCUMENTS 4,522,619 6/1985 Bunch, Jr. ..... 493/415

OTHER PUBLICATIONS

Photoelectric Register Controls, pp. 38–42, Allan Lytel, Jan. 1960.

*Primary Examiner*—Frederick R. Schmidt

*Assistant Examiner*—Jack Lavinder

*Attorney, Agent, or Firm*—Tod R. Nissle

[57] ABSTRACT

A machine for producing continuous form stationery by folding a strip of paper along transverse lines of weakening formed therealong. The machine includes a dispensing roller which directs a continuous strip of paper into a mechanism which distributes successive lines of weakening formed in the paper in substantially opposite directions and having additional mechanisms for creasing the distributed paper along the lines of weakening to produce continuous form stationery. The machine also includes a drive shaft which delivers motive power to the paper distribution mechanism and is synchronized with the dispensing roller, the motive power being transmitted to the drive shaft through a removable gear member having a selected outer diameter which varies with the fold length of paper directed into the distributing mechanism. The preferred embodiment of the machine dose not require that the gear member on the drive shaft be replaced with a different diameter gear member when the fold length of paper directed into the distribution mechanism changes.

7 Claims, 7 Drawing Sheets

SPIRAL PAPER FOLDING MACHINE WITH AUTOMATIC CHANGE GEAR ADJUSTMENT

This invention relates to apparatus for producing continuous form stationery by folding a strip of paper along transverse lines of weakening formed therealong.

More particularly, the invention concerns an improved stationery folding machine of the type having a dispensing roller which directs a continuous strip of paper into a mechanism which distributes successive lines of weakening formed in the paper in substantially opposite directions and having additional mechanisms for creasing the distributed paper along the lines of weakening to produce continuous form stationery.

In another respect, the invention concerns an improved paper folding machine of the type described which includes a drive shaft which delivers motive power to the paper distribution mechanism and is synchronized with the dispensing roller, the motive power being transmitted to the drive shaft through a removable gear member having a selected outer diameter which varies with the fold length of paper directed into the distributing mechanism.

In a further respect, the invention concerns an improved paper folding machine of the type described which does not require that the gear member on the drive shaft be replaced with a different diameter gear member when the fold length of paper directed into the distribution mechanism changes.

In still another respect, the invention concerns an improved paper folding machine of the type described in which a motor supplies motive power to the drive shaft and can be utilized to retard or advance automatically the drive shaft with respect to the paper dispensing roller.

Spiral paper folding machines and other types of paper folding machines are will known in the art. See, for example, U.S. Pat. No. 4,522,619 to Bunch, issued June 11, 1985, and U.S. Pat. No. 3,912,252 to Stephens, issued Oct. 14, 1975, both of which are incorporated herein by reference. Spiral paper folding machines fold in zig-zag fashion a strip of paper along transverse lines of weakening formed therealong to produce continuous form stationery. A spiral paper folding machine includes a feed roller which dispenses a continuous strip of paper into an oscillating chute. The chute distributes successive lines of weakening formed in the paper in substantially opposite directions. Spirals and beaters receive the paper distributed by the chute and crease the paper along the transverse lines of weakening to produce continuous form stationery. Motive power is supplied to the machine along a gear train which first delivers power to the feed roller. The gear train also includes a drive shaft which delivers power to the portion of the gear train extending from the drive shaft to the chute, the spirals and the beaters. A removable, circular, toothed gear is attached to the drive shaft. By way of example, this gear is illustrated as reference character 81 in FIG. 3 of U.S. Pat. No. 4,522,619 to Bunch. As noted at Col. 6, lines 15 to 18 of U.S. Pat. No. 4,522,619, various sized gears are used to rotate the drive shaft 23*a*, the size gear 81 used depending on the distance between successive lines of weakening in the paper, i.e., depending on the fold length. A differential mechanism 24 is also described in U.S. Pat. No. 4,522,619 and, as noted in Col. 6, lines 54 to 61, is used to adjust the synchronized timing of the chute, the beater, and the spirals in relation to the paper dispensing roller 17 and to the position of the lines of weakening in the paper as they pass through and are distributed by the chute. A principal drawback associated with the spiral folding machine described in U.S. Pat. No. 4,522,619 is that changing the removable gear on the drive shaft 23*a* takes time. Further, operating the differential mechanism 24 requires the operator to visually monitor the position of lines of weakening as they pass through the mouth of the chute and to appropriately manually adjust the differential mechanism. End users of the spiral folding machines are often office workers who have lesser mechanical and technical skills and do not readily understand gear changes and other adjustments required to operate a spiral folding machine.

Accordingly, it would be highly desirable to provide an improved paper folding machine which would automatically adjust the drive shaft gear size and retard and advance the folding mechanisms with respect to the lines of weakening in the paper.

Therefore, it is a principal object of the invention to produce an improved apparatus for producing continuous form stationery by folding a strip of paper along transverse lines of weakening formed therealong.

Another object of the invention is to provide an improved paper folding machine which automatically compensates for changes in the drive shaft gear size and advances and retards the position of lines of weakening in the paper with respect to the folding mechanisms.

These and other, further and more specific objects and advantages of the invention will be apparent to those skilled in the art from the following detailed description, taken in conjunction with the drawings, in which.

Figure 1:
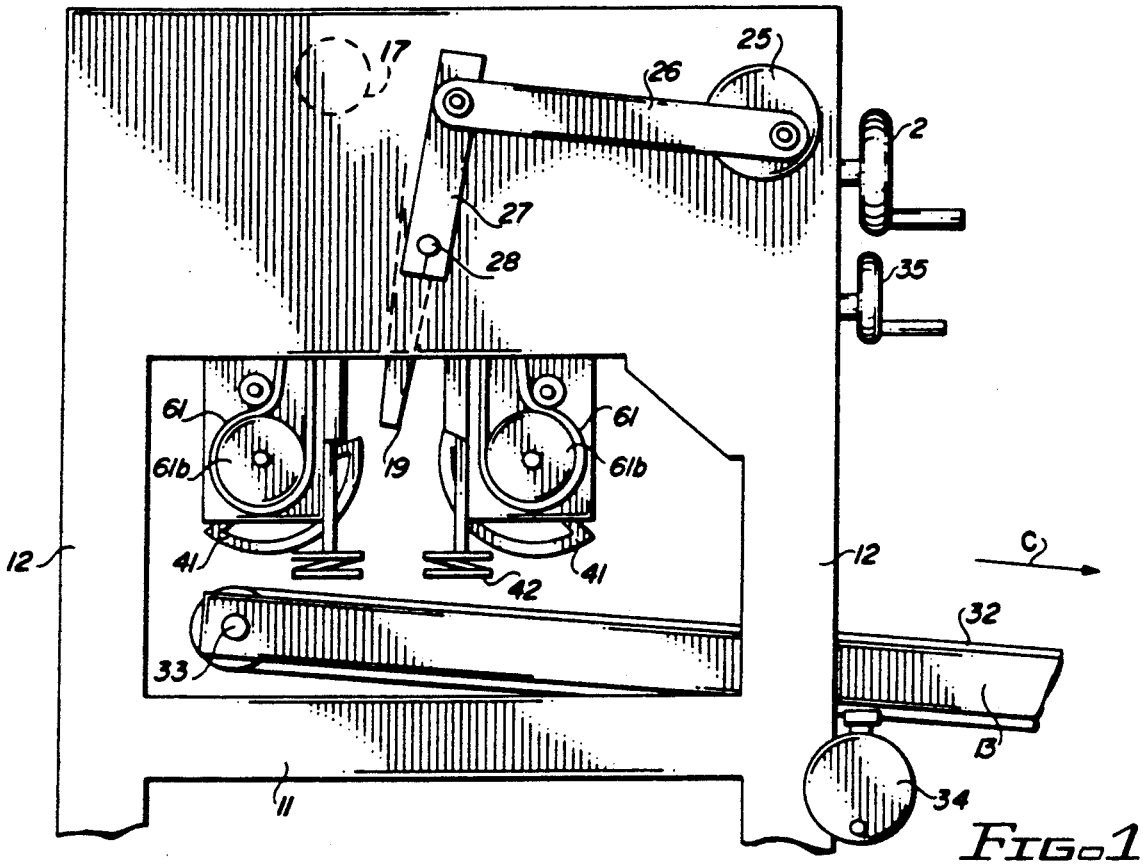
FIG. 1 is a side view of a spiral paper folding machine constructed in accordance with the principles of the invention.

Briefly, in accordance with my invention, I provide an improved apparatus for producing continuous form stationery by folding a strip of paper along transverse lines of weakening formed therein. The apparatus includes a frame; oscillating guide means mounted on the frame for alternately distributing the successive lines of weakening in the paper in substantially opposite directions; means for feeding the paper into the guide means at a predetermined speed, the paper having first and second spaced apart elongate edges; and, folding means carried on the frame and operatively associated with the oscillating guide means for urging the paper distributed by the guide means into a folded condition. The apparatus also includes gear train means for transmitting motive power to actuate the oscillating guide means and the folding means; a drive shaft for transmitting motive power to said gear train means actuating said oscillating means and folding means; means for transmitting motive power to the dispensing means; and, power means to drive the means for transmitting motive power to the dispensing means. The guide means, feeding means and folding means move in synchronous relationship during the operation of the apparatus. The improvement comprises means for rotating the drive shaft at a selected number of revolutions per minute in relation to the speed at which the dispensing means feed the strip of paper into the oscillating guide means and in relation to the distance between one of the folded lines of weakening and another of the folded lines of weakening immediately succeeding said one of the folded lines of weakening. The drive shaft rotating means includes sensor means for determining the speed at which the dispensing means feeds the strip of paper into the oscillating guide means and for generating paper velocity signals representing the velocity in units of length per unit of time of said strip of paper directed into the oscillating guide means; and, motor means connected to the drive shaft and responsive to the paper velocity signals to rotate the drive shaft a selected number of revolutions per minute for a selected unit of length per unit of time of the velocity of the strip of paper. The motor means maintains the synchronous relationship between the feed roller and the paper distribution means, and, causes the oscillating guide means to oscillate a selected number of times with respect to the distance between the one and the other lines of weakening.

The apparatus of the invention can also include means for sensing at a selected point along the path of travel of the strip of paper through the apparatus at least a pair of reference points on the strip of paper sequentially passing by said selected point and for generating reference point paper alignment signals, the reference points being a known distance apart prior to the strip of paper traveling through the apparatus; and, means operatively associated with the motor means and responsive to the reference point alignment signals to determine the operational distance between the reference points when the strip of paper is moving along the path of travel past the selected point, to compare and determine any deviation between the known distance and the operational distance, and to adjust the rotation of the drive shaft by the motor to compensate for deviation between the known distance and the operational distance to synchronize the position of the lines of weakening in the strip of paper with respect to the folding mechanisms.

Turning now to the drawings, which depict the presently preferred embodiments of the invention for the purpose of illustrating the practice thereof and not by way of limitation of the scope of the invention, and in which like reference characters identify corresponding elements throughout the several views, FIG. 1 illustrates the general arrangement of the elements in a conventional spiral paper folding machine. A frame consisting of horizontal members 11 and vertical members 12 supports conveyor table 13 and various paper folding mechanisms. A continuous strip of paper or other material is directed by a dispensing roller (not visible in FIG. 1) into chute 19 or other oscillating guide means. Transverse lines of weakening along paper entering chute 19 are distributed in substantially opposite directions as chute 19 oscillates. The paper distributed by chute 19 is compressed and folded by beaters 41 and spirals 42. Continuous moving belts carried by roller 33 carry the folded paper away from the folding mechanisms in the direction of arrow C. Oscillating arm 27, oscillating shaft 28, link 26, and rotating gear 25 transmit motive power to oscillating chute 19. Link 26 is pivotally attached to arm 27 and gear 25. Gear 25 is carried by and rotates with shaft **23*b*. The slope of table 13 is adjusted by turning handle 34. Handle 35 is turned to adjust the position of the spirals, beaters and paper stops. The paper stops are not visible in FIG. 1, nor are all of the spirals and beaters. Handle 2 is utilized to simultaneously laterally adjust a front and rear spiral. The spiral paper folding machine illustrated in FIGS. 1 to 3 herein corresponds in many respects to the machine described in U.S. Pat. No. 4,522,619. The general operation of spiral paper folding machines is well understood in the art. To facilitate, however, the understanding of how the particular conventional spiral folding machine of FIGS. 1 to 3** herein operates, like reference characters herein and in U.S. Pat. No. 4,522,619 identify corresponding elements.

Figure 2:
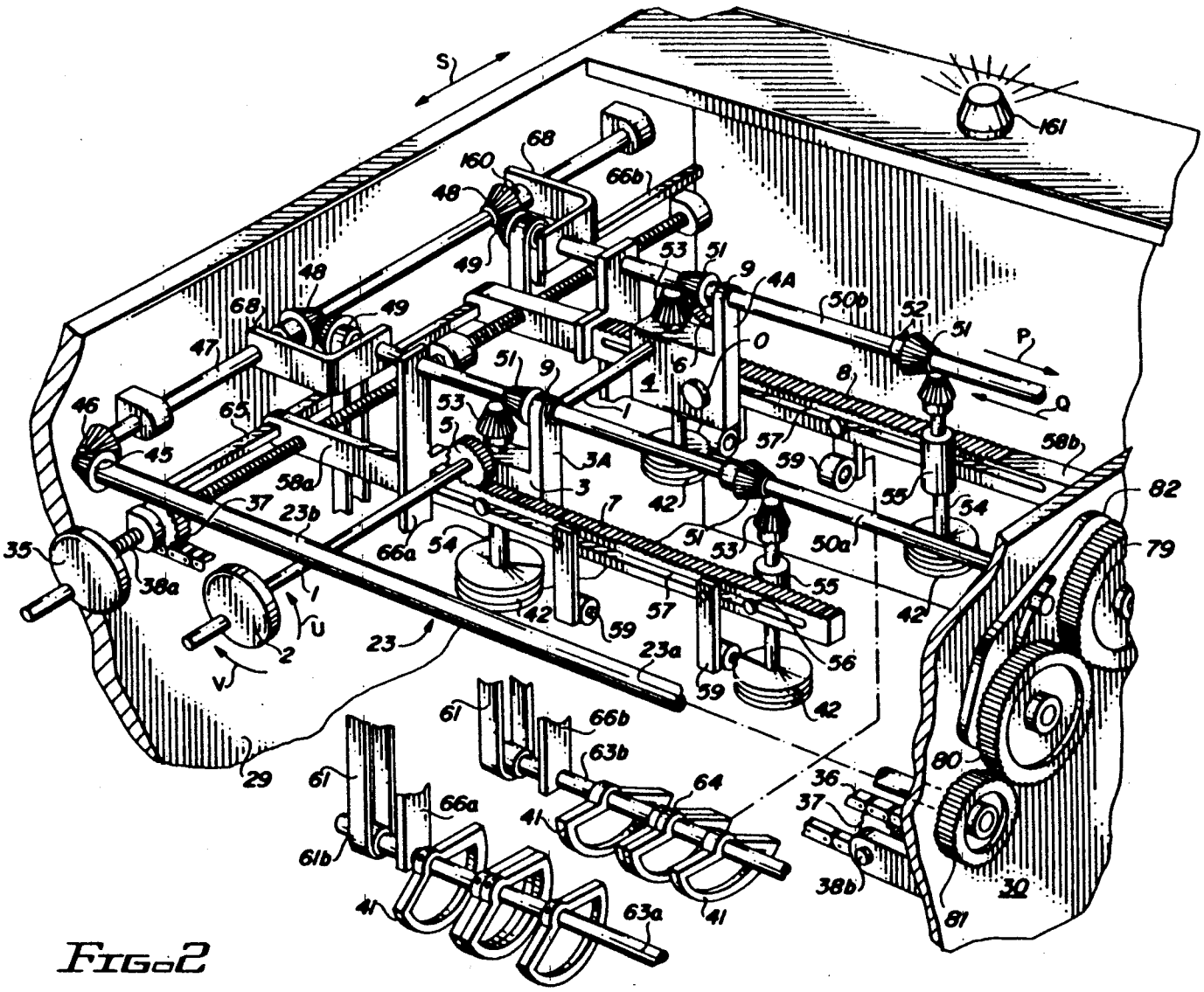
FIG. 2 is a top perspective view of the spiral paper folding machine of FIG. 1 illustrating the arrangement of certain of the folding and power transmission gear mechanisms thereof.

In FIG. 2, shafts **23*b* and 23*a* are fixedly connected and simultaneously rotate. Shaft 23*b* is connected to and rotates gear 25. Threaded shafts 38*a* and 38*b* each carry a sprocket 37 which engages continuous chain 36. By turning handle 35, shaft 38*a* is rotated causing the teeth of sprocket 37 to engage and turn continuous chain 36 so that sprocket 37 and shaft 38*b* simultaneously rotate. Rotation of shafts 38*a* and 38*b* forwardly and rearwardly adjusts the positions of the beater, the spirals, and the paper stops. Drive shaft 23*b* is provided with a pinion gear 45 which drives gear 46 to rotate shaft 47 and bevel gears 48 mounted thereon. Gears 48 drive bevel gears 49 to rotate shafts 50*a* and gears 51 which are secured to shaft 50 by setscrews 52. Pinion gears 51 turn beveled gears 53 to rotate shafts 54 and spirals 42. Paper stops 59 are fixedly adjustably attached to bars 58 by set screws 60 and can, therefore, be transversely adjusting along bars 58**.

A rear set or pair of spirals 42 is operatively associated with rotatable shaft **50*b*. A front set or pair of spirals 42 is operatively associated with rotatable shaft 50*a*. The shaft 54 of one of the rear set of spirals 42 is rotatably journalled in control box 4. The shaft 54 of the rear set of spirals 42 is journalled for rotation in a sleeve 55. The shaft 54 of one of the front set of spirals 42 is journalled for rotation in control box 3. The shaft 54 of the other of the front set of spirals 42 is journalled for rotation in a sleeve 55. Sleeve 55 are provided with set screws 56 for transversely adjusting the position of spirals 42 along slot 57 in support bars 58**.

When shafts 50*a* and 50*b* are rotated, continuous belts 61 mounted on rollers affixed to rods 50 and 63 turn and simultaneously rotate shafts 63*a* and 63*b* on which beaters 41 are adjustably mounted. On shafts 63*a*, 63*b* belts 61 turn around rollers 61*b*. Set screws 64 permit beaters 41 to be positioned along shafts 63.

When threaded shafts 38*a* and 38*b* are rotated by turning handle 35, support bars 58*a* and 58*b* are moved in the directions indicated by arrows S along rails 65 horizontally fixedly attached to the interior of panels 39 and 30. Member 66*a* interconnects (in FIG. 2) the left hand ends of shaft 50*a*, bar 58*a* and rod 63*a*. A second member having dimensions equivalent to member 66*a* interconnects the right hand ends of shaft 50*b*, bar 58*b* and rod 63*b* so that when threaded rods 38*a* and 38*b* are rotated shaft 50*a*, bar 58*a* and rod 63*a* move forwardly or rearwardly in unison. Member 66*b* (in FIG. 2) interconnects the left hand ends of shaft 50*b*, bar 58*b* and rod 63*b*. A second member 66*b* (not visible in FIG. 2) interconnects the right hand ends of shaft 50*b*, bar 58*b* and rod 63*b* so that when threaded rods 38*a* and 38*b* are rotated, shaft 50*a*, bar 58*a* and rod 63*a* move forwardly or rearwardly in unison in the directions indicated by arrows S. When the position of bars 58*a* and 58*b* are adjusted along threaded rods 38*a* and 38*b*, gears 48 slide along rod 47. L-shaped brackets 68 function to keep pinion gears 48 meshed with gears 49. Set screws 160 in gears 48 thread into an elongate longitudinal U-shaped slot (not visible) formed in shaft 47. Screws 160 permit gears 48 to freely slide longitudinally along shaft 47 while also insuring that gears 48 will rotate simultaneously with shaft 47.

Shaft 1 is rotatably journalled in and extends through control boxes 3 and 4. Toothed gears 5 and 6 are fixedly attached to and rotate with shaft 1. Gears 5 and 6 engages toothed tracks 7 and 8 respectively. A circular U-shaped grooves is formed in the neck of the pinion gears 51 adjacent control boxes 3 and 4. Each U-shaped groove contours to and rotatably receives a U-shaped slot formed in the top of arms 3A and 4A of control boxes 3 and 4, respectively. When one of these U-shaped slots engage a U-shaped groove in a pinion gear 51, the gear 51 is free to rotate with a shaft 50*a*, 50*b*. When, however, a control unit 3, 4 moves transversely or laterally in the directions of arrows P or Q, then rigid arms 3A and 4A force pinions 51 to also move laterally. The pinion gears 51 adjacent control boxes 3, 4 are each provided with a set screw. These set screws thread into a longitudinal U-shaped groove formed in each shaft 50*a* and 50*b*. Consequently, screws 52 enable the gears 51 adjacent boxes 3, 4 to slide along shafts 50*a* and 50*b* in the direction of arrow P or arrow Q when boxes 3, 4 (and arms 3A and 4A) move in the direction of arrow P or arrow Q. Further, screws 52 cause gears 51 adjacent boxes 3 and 4 to rotate with shafts 50*a* and 50*b* in the directions indicated by arrows R.

Handle 2 is manually grasped and rotated in the direction of arrow U or arrow V to rotate shaft 1 in a corresponding direction. A motor or any other desired means can be provided to rotate shaft 1. One motor can, if desired, be provided to rotate the portion of shaft 1 extending through gear 5 and box 3. Another separate motor can be provided to rotate the portion of shaft 1 extending through gear 6 and box 4. When two separate motors are utilized to turn gears 5 and 6, respectively, boxes 4 and 5 can still be moved simultaneously, even though they are independently controlled by separate motors.

Figure 3:
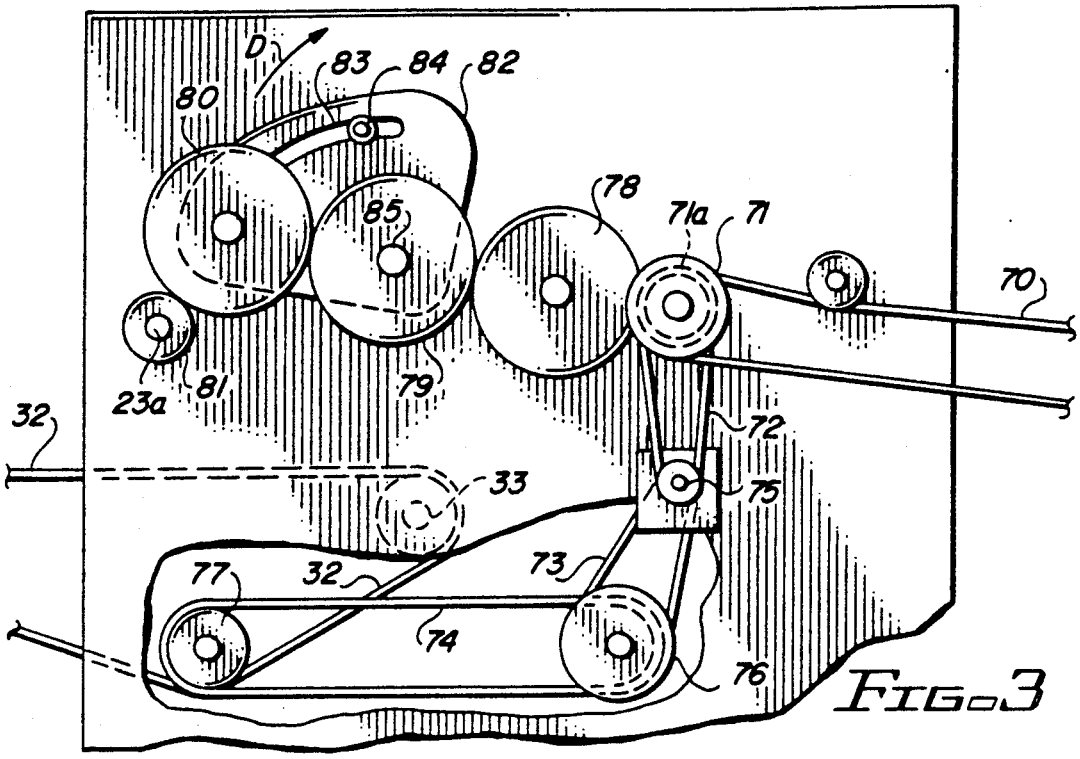
FIG. 3 is a schematic drawing of the right hand side of the paper folding machine of FIG. 1 illustrating the drive mechanism which activates the power dispensing roller and further transmits motive power to that portion of the gear train activating the paper folding and distributing mechanisms.

Any desired motive power means can be provided to rotate shaft 23, and the portions 23*a* and 23*b* comprising shaft 23, and to power the folding mechanisms illustrated in FIGS. 1 and 2. Any desired paper feed mechanism can be utilized to direct a strip of paper into chute 19. U.S. Pat. No. 4,522,619 illustrates conventional feed or dispensing roller mechanism 17 used in paper folding machines. Such a feed roller 17 is indicated by dashed lines 17 in the FIG. 1 of the drawings herein. As shown in FIG. 3, gear 71 is actuated by belt 70 from power means (not shown) which drive the gear train. Continuous belts 72, 73 and 74 transmit power to conveyor belts 32 of table 13 through pulley gear 75 and rollers 76, 77. Motive power from gear 71 is transmitted through sector gears 78, 79 and 80 to removable toothed gear 81. Gear 80 is attached to plate 82 having slot 83 formed therein and which is rotatably mounted on rod 85. In order to remove gear 81 from shaft 23*a*, gear 80 is upwardly lifted in the direction of arrow D by loosening set screw 84 in slot 83. Depending on the distance between successive lines of weakening in the paper being folded, various sized gears 81 are used to rotate drive shaft 23. Dispensing roller 17 is carried on axle 71*a* journalled for rotation in panels 29, 30. Roller 17 and axle 71*a* are omitted from FIG. 2 for the sake of clarity.

Handle 2 is rotated to simultaneously laterally move control boxes 3 and 4, and the spirals 42 journalled for rotation therein, in the direction of arrow P or arrow Q. The spirals in FIG. 2 which are journalled for rotation in sleeves 55 can also, in an alternate embodiment of the invention, be journalled for rotation in control boxes similar to boxes 3 and 4 and be provided with a shaft 1 and handle 2 which enables the spirals journalled for rotation in sleeves 55 in FIG. 2 to be simultaneously laterally displaced in the direction of arrow P or of arrow Q. In the embodiment of the invention illustrated in FIG. 2, however, the spirals journalled for rotation in sleeves 55 normally remain in fixed position, and engage one edge 87B of the two parallel, spaced apart edges 87A, 87B of a strip of paper 87 moving through the machine. Handle 2 is rotated so the spirals 42 carried by boxes 3, 4 are laterally simultaneously displaced in the direction of arrow P or arrow Q so the spirals 42 carried by boxes 3, 4 are positioned to engage edge 87A of paper strip 87.

Before handle 2 can be manually rotated to properly laterally position the spirals 42 carried in boxes 3 and 4, the position of edge 87A of paper 87 with respect to shaft 1 and the spirals in boxes 3 and 4 must be determined. This determination can be made visually by the operator of the machine or can be made with some other sensing means.

Figure 4A:
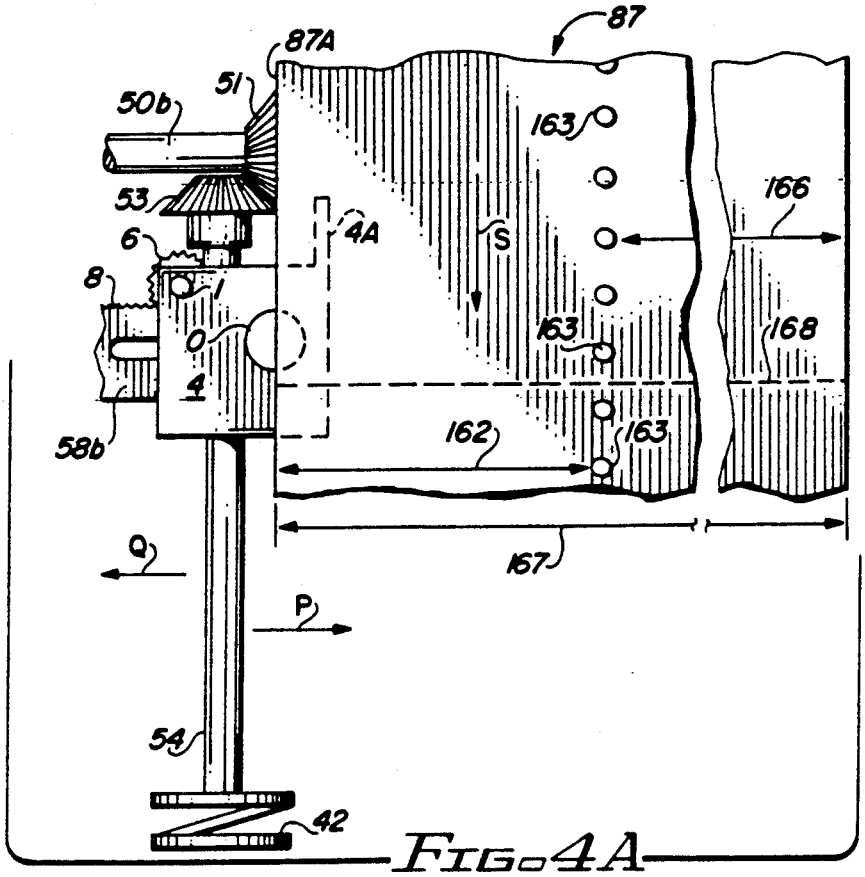
FIG. 4A is a front view of a portion of the gear arrangement of FIG. 2 illustrating a sensor used to locate spaced apart reference points on a strip of paper traveling through the paper folding machine.
Figure 4B:
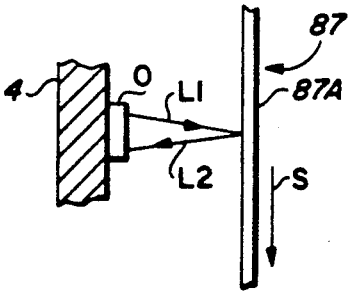
FIG. 4B is a side view illustrating the sensor of FIG. 4A.
Figure 5:
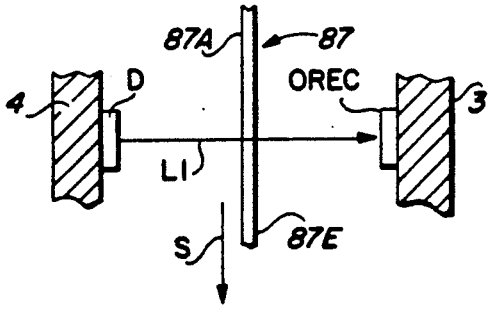
FIG. 5 is a side view illustrating an alternate sensor construction.

In FIG. 4A an optical sensor O mounted on box 4 is used to detect when each line of perforation 168 in paper 87 moves past sensor O. Sensor O can be utilized in place of or in conjunction with sensor 175 in FIG. 6. In FIGS. 4A and 4B, sensor O operates by reflecting a beam of light L1 off of strip 87. When beam L1 is reflected L2 off of strip 87 and detected by sensor O, then sensor O has detected strip 87. When beam L1 is reflected off of a line of weakening 168, the intensity of beam L1 is reduced and sensor O has detected line of weakening 168. An alternate sensor arrangement is illustrated in FIG. 5. Sensor O is used in conjunction with a receiving sensor OREC. As long as OREC does not detect light beam L1, a line of weakening 168 is not detected. Once a selected proportion of the light intensity in beam L1 passes through a line of weakening and is detected by sensor OREC, then a line of weakening 168 is detected. Apparatus constructed in accordance with the invention is illustrated in the schematic illustration of FIG. 6. Sensor 172 is mounted on and operatively associated with shaft 71*a*. Sensor 172 generates 600 primary pulses or electromagnetic waves for each revolution of shaft 71*a* and feed roller 17. Each pulse presently has a "width" of 250 nanoseconds. The outer diameter of the feed roller 17 is ten inches. Therefore, sensor 172 produces 60 pulses for each inch of paper which travels over the feed roller 17 toward the chute 19. Primary pulses from sensor 172 are directed 181 to control unit 174. The control unit 174 includes a multiplier 182 which produces ten secondary pulses for each primary pulse 181 received from sensor 172. The multiplier therefore produces 6000 secondary pulses for each 600 primary pulses received 181 from sensor 172. A first counter 300, which will be explained below with respect to FIG. 10, sends a pulse 246 to stepper motor 176 each time the first counter receives a selected number of pulses from the multiplier. Each pulse 246 received by stepper motor 176 causes the stepper motor to rotate through 1.8 degrees of revolution. Rotating the stepper motor through 180 degrees (one half revolution) causes the shafts 23*a* and 23*b* to rotate through a full revolution of 360 degrees. Consequently, when motor 176 receives one hundred pulses, motor 176 rotates through 180 degrees and turns shaft 23 one full revolution. When shaft 23 rotates one full revolution, the chute 19 rotates through a full cycle and dispenses two fold lengths of paper. Pushing button 177 on control unit 174 causes the control unit to send an additional pulse 246 to stepper motor 176. Sending additional pulses to motor 176 advances the folding mechanisms with respect to lines of weakening in the paper being folded. Pushing button 178 causes control unit 174 to omit a pulse 246 which ordinarily would be sent to motor 176 after control unit 174 received a selected number of pulses 181 from sensor 172. Omitting a pulse 246 to motor 176 retards the folding mechanisms with respect to lines of weakening in the strip of paper being folded.

Each time opto sensor 175 detects a reference mark 173 on paper strip 87, sensor 175 sends a pulse 245 to a secondary counter 400 in control unit 174. The secondary counter is more fully described below with respect to FIG. 11. The secondary counter, as does the first counter, also receives from the multiplier 182 in the control unit 174 a stream of pulses equivalent to 6000 pulses per inch of paper traveling over the feed roller into the chute 19. Each time the secondary counter receives a pulse 245 from sensor 175 the secondary counter resets itself and begins counting pulses from zero. If the secondary counter receives a pulse 145 from sensor 175 before the secondary counter has received and counted a selected number of pulses from the multiplier 182, then the secondary counter sends an additional or supplemental pulse 246 to the stepper motor because the reference marks are ahead of the paper folding mechanisms. If the secondary counter receives a pulse 245 from sensor 175 after the secondary counter has received and counted a selected number of pulses from the multiplier 182, then the reference marks 173 are behind the paper folding mechanisms and the secondary counter prevents the first counter from sending a pulse 246 to the stepper motor. When the secondary counter 400 deletes a pulse 246 from the pulse train being sent to motor 176 by the first counter, this permits the lines of weakening and reference marks 173 to "catch up" with the folding mechanisms and to regain their synchronized relationship with the folding mechanisms.

While paper strip 87 passes through the folding apparatus of the invention, the paper strip 87 tends to stretch or, possibly, under certain conditions tends to contract. Such stretching or contracting of the paper causes the lines of weakening in the paper to move out of their proper synchronized position with the folding mechanisms as the paper strip 87 moves through the paper folding machine. In particular, when the paper dispensing mouth of chute 19 is in a selected position along its arc of travel, then the line of weakening which is moving in a direction of travel away from the feed roller toward the dispensing mouth of the chute and which is closest to the dispensing mouth of the chute should be a selected distance away from the dispensing mouth of the chute. If, instead, this line of weakening which is closest to the dispensing mouth of the chute is a distance away from the dispensing mouth of the chute which is greater than said selected distance from the chute mouth, then the lines of weakening are out of synchronism with the folding mechanisms of the paper folding machine. If the lines of weakening are out of synchronism by relatively small amounts, say of eighth of an inch or less, the paper folding machine likely will function. If, however, the lines of weakening are out of synchronism by significant amounts, then the maximum operating speed of the folding machine will be less and the tendency for the machine to jam or to not properly fold the strip of paper 87 along its lines of weakening 168 will increase. Sensor 175 and control mechanisms 174, along with stepper motor 176, automatically compensate for the stretching or contraction of paper or for other operational conditions which cause the paper and lines of weakening in the paper to lag behind or run ahead of synchronism with the folding mechanisms of the paper folding machine of the invention.

Figure 10:
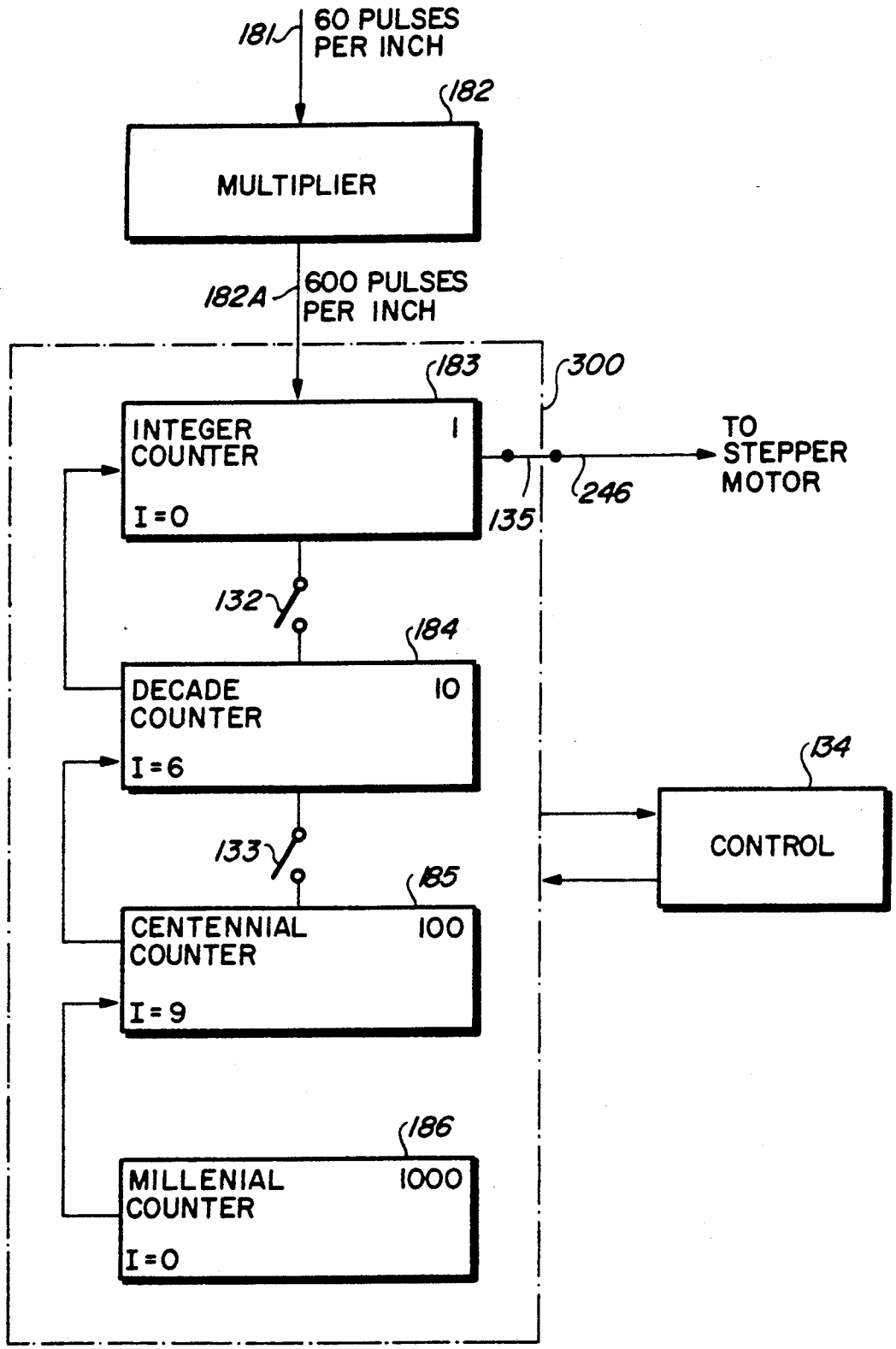
FIG. 10 is a block flow diagram of a counter system utilized in the apparatus of FIG. 6; and, FIG. 11 is a block flow diagram of another counter system utilized in the apparatus of FIG. 6.

FIG. 10 illustrates the first counter in control unit 174. The first counter receives from the multiplier 182 six hundred pulses per inch of paper passing over the feed roller 17. Pulses 182A from the multiplier are received by the integer counter 183 of the first counter 300. Counter 300 also includes decade counter 184, centennial counter 185, and millennial counter 186. At the outset of operation of the paper folding machine, the integer counter 183 is initialized with I=0; the decade counter is initialized with I=6; the centennial counter is initialized with I=9; and, the millennial counter is initialized with I=0. These initialized values cause, as will be seen, the first counter 300 to generate a pulse each time it receives ninety-six pulses from multiplier 182. Each time counter 300 generates a pulse 246 to the stepper motor, counter 300 resets itself to the preliminary initial I values noted above, counts another ninety-six counts, generates a pulse 246 to the stepper motor, resets itself again to the preliminary initial I values, etc. The first counter 300 also includes switches 132, 133, 135 and control 134. The counter 300 is, as noted, initialized to produce a pulse 246 to stepper motor 176 for each ninety-six pulses received from multiplier 182 by counter 300. The ninety-six pulses required to produce a pulse 245 to motor 176 is derived from the fact that the fold length (i.e., the distance between a first folded line of weakening and the next immediately succeeding folded line of weakening) is, in this example, eight inches and that the circumference of the cylindrical feed roller 17 is ten inches. This is better explained with reference to TABLE I below.

TABLE I

CALCULATION OF MULTIPLIER PULSES REQUIRED PER PULSE TO STEPPER MOTOR

| | FOLD LENGTH** (inches) | | |
|---|---|---|---|
| | 4.0 | 8.0 | 16.0 |
| Length of paper through chute during one cycle of chute | 8.0 | 16.0 | 32.0 |
| Encoder pulses produced during one cycle of chute @ 60 pulses/inch | 480.0 | 960.0 | 1920.0 |
| Multiplier pulses produced during one cycle of chute @ 600 pulses/inch | 4800.0 | 9600.0 | 19200.0 |
| Number of multiplier pulses required to produce one pulse to stepper motor. One pulse to stepper motor rotates the motor through 1.8° revolution. ½ revolution of stepper motor rotates power shaft one revolution. | 48 | 96 | 192 |

**1. Circumference of input (feed) roller is ten (10) inches.
2. Rotary encoder produces 600 pulses per revolution of input roller. Rotary encoder produces 60 pulses per inch of paper dispensed by input roller.

As shown above in TABLE I, when the fold length is eight inches, then sixteen inches of paper is distributed during one cycle of the chute. During a cycle, the chute twice approximately swings through its arc of travel. During the time it takes the chute to distribute sixteen inches of paper, sensor 172 will produce nine hundred and sixty pulses to the multiplier 182 in control unit 174. Similarly, during the time it takes the chute to distribute sixteen inches of paper, the multiplier 182 will produce 9600 pulses. Since the chute must pass through one cycle to distribute sixteen inches of paper, stepper motor 176 should rotate shaft 23 one revolution. Rotating shaft 23 one revolution causes the chute 19 to move through one cycle. The stepper motor must rotate one hundred and eighty degrees (one half revolution) to rotate shaft 23 one revolution (360 degrees). One hundred pulses 246 are required to rotate motor 176 through one hundred and eighty degrees. The 9600 pulses per sixteen inches produced by multiplier 182 are divided by the one hundred pulses 246 required to move the motor 176 through one hundred and eighty degrees. 9600 divided by one hundred gives 96 pulses from the multiplier 182 which must be received by counter 300 in order to generate one pulse 246 to the stepper motor 176. Accordingly, counter 300 is initialized with I=0 in the integer counter, with I=6 in the decade counter, with I=9 in the centennial counter, with I=0 in the millennial counter, and with switches 132, 133 open. In operation of the counter 300, for each of the first six pulses **182*a* received from multiplier 182, the decade counter unloads an integer count to the counter 182. Once the integer counter 183 counts six pulses, I=0 in the decade counter 184 and switch 132 closes. For each of the next nine sets of ten counts, the centennial counter 185 unloads a set of ten counts to the decade counter 184. After the decade counter 184 has counted ninety pulses, I=0 in the centennial counter 185 and switch 133 closes. At the moment switch 133 closes, I=0 in each counter 183 to 186, counter 183 sends a pulse 246 to the stepper motor 176, and control 134 reinitializes counter 300 so that each counter has the I value shown in FIG. 10. Control 134 also opens switches 132 and 133. Counter 300 then counts another ninety-six pulses, sends a pulse 246 to motor 176, etc. When button 177 on control unit 174 is depressed, switch 135 is opened so that pulses 246 from integer counter 183 are prevented from reaching stepper motor 176. When button 177 is released, then switch 135 is closed. When button 178 on control unit 174 is depressed, integer counter 183 is caused to produce pulses 246 at a rate faster than the rate at which counter 300 counts ninety-six pulses and produces a pulse 246 to the stepper motor 176. When button 178 is released, counter 300 only produces a pulse 246 each time counter 300 receives 96 pulses from multiplier 182**.

Figure 11:
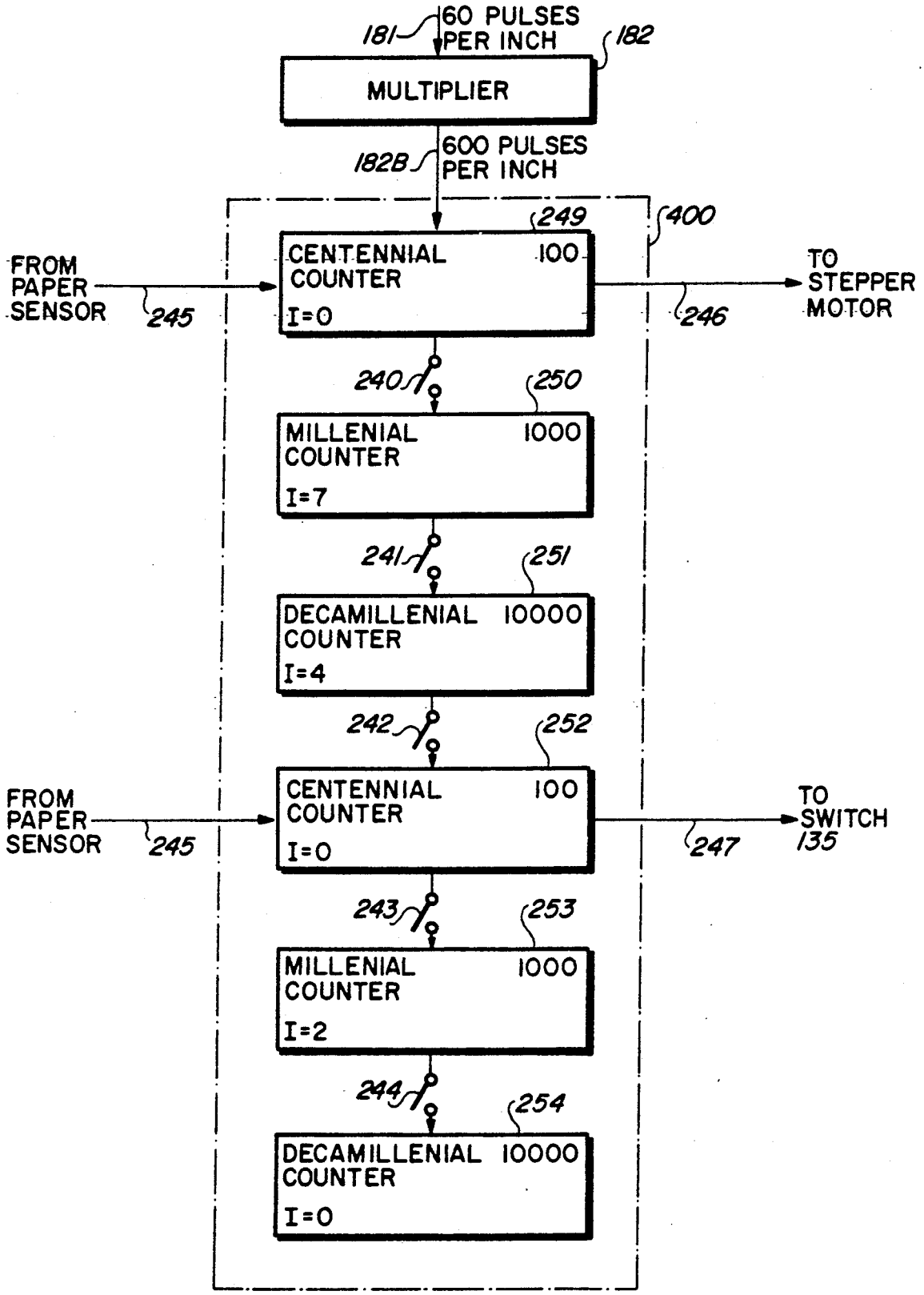

FIG. 11 illustrates the second counter in control unit 174. The second counter is utilized to automatically compensate for when the lines of weakening passing through the paper folding machine lag behind or run ahead of the desired synchronization of the lines of weakening with paper folding mechanisms in the machine. The second counter 400, as does the first counter 300, receives **182*b* from multiplier 182 six hundred pulses per inch of paper passing over the feed roller 17. Each pulse 182*b* from multiplier 182 is received by centennial counter 249. At the outset of operation of the paper folding machine, centennial counter 249 is initialized at zero; millennial counter 250 is initialized at I=7; decamillennial counter 251 is initialized at I=4; centennial counter 252 is initialized at I=0; millennial counter 253 is initialized at I=2; and decamillennial counter is initialized at I=0. Switches 240 to 244 are open. In FIG. 11, it is assumed that the control unit for counter 400 is included in the centennial counter 249. Second counter 400 also includes switches 240, 241, 242, 243, and 244. Counters 249 to 251 are initialized to count to 4700. Counters 252 to 254** are initialized to count to two hundred.

Figure 6:
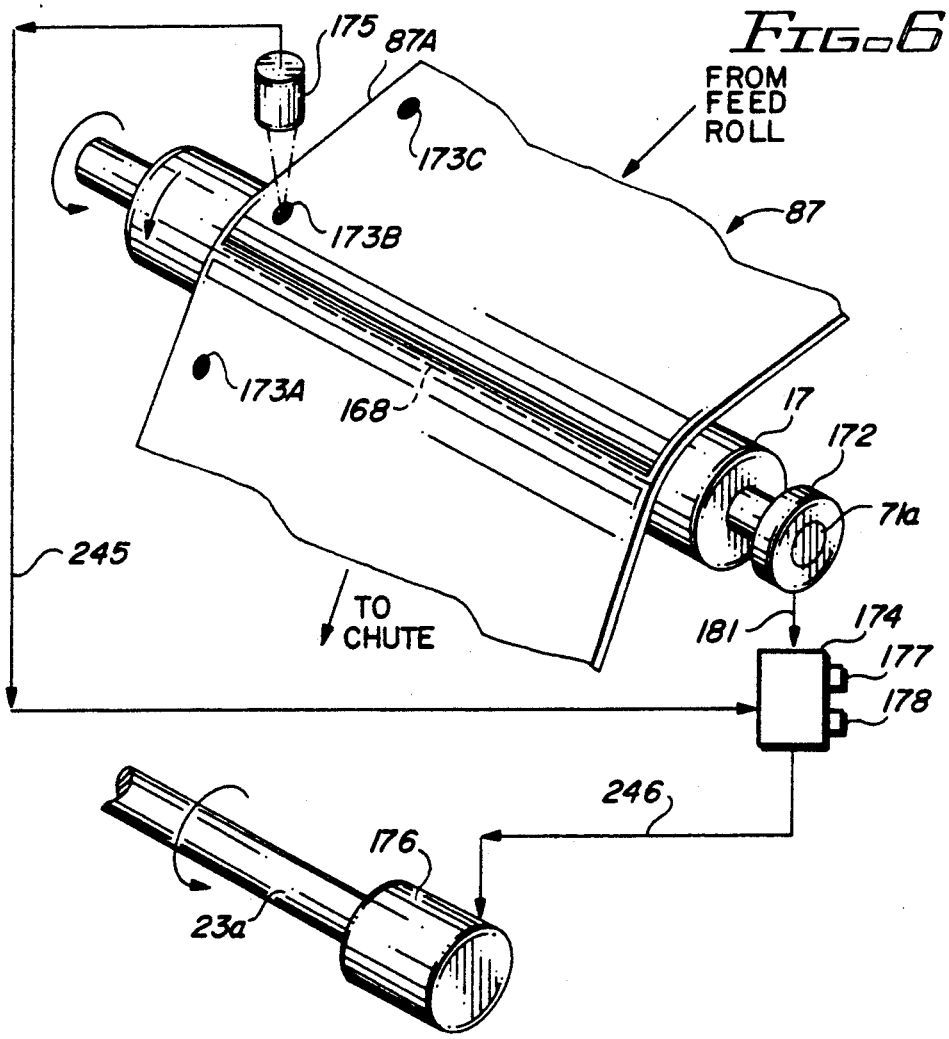
FIG. 6 is a schematic drawing illustrating apparatus for automatically compensating for changes in the size gear used on the drive shaft and for changes in the position of lines of weakening with respect to the folding mechanisms.

In FIG. 6, the distance between each pair **173*a*—173*b*, 173*b*—173*c* of reference marks is, for sake of this example, assumed to be eight inches. Consequently, multiplier 182 normally produces 4800 pulses when the paper strip 87 moves from a position with one reference mark 173*b* under stationary sensor 175 to another position with the next successive reference mark 173*c* underneath sensor 175. The counter 400 in FIG. 11 is set up so that if counter 400 receives fewer than 4701 pulses from multiplier 182 before it receives a pulse 245 from sensor 175 then counter 249 sends a supplemental or additional pulse 246 to the stepper motor 176 to advance the folding mechanisms with respect to the paper. If the counter 400 in FIG. 11 receives more than 4900 pulses from multiplier 182 before counter 400 receives a pulse 245 from sensor 175, then counter 252 causes switch 135 to open to prevent a pulse 246 produced by counter 183 from reaching stepper motor 176. After switch 135 has been open a period of time to insure that at least one pulse 246 has been prevented from reaching motor 176, then counter 252 closes switch 135 so that subsequent pulses 246 produced by counter 183 will continue to reach motor 176 More specifically, in operation of the counter 400, for each of the first seven sets of one hundred counts, the millennial counter 250 downloads a set of one hundred counts to the centennial counter. When all seven sets of one hundred counts have been downloaded to the centennial counter and counter 249 has received seven hundred pulses, I=0 in the millennial counter and switch 240 closes. For each of the next four sets of one thousand counts received by the millennial counter 250, the decamillennial counter 251 downloads a set of one thousand counts to the millennial counter. When all four sets of one thousand counts have been downloaded to the millennial counter and counter 250 has received four thousand pulses, I=0 in the decamillennial counter and switch 242 closes. If prior to the closing of switch 242 counter 249 receives a pulse 245 from sensor 175, then counter 249 sends a supplemental pulse 246 to motor 176 and counters 250 and 251 are reinitialized with I=7 and I=4, respectively, and switches 240 and 241 are opened. If prior to the closing of switch 242 counter 249 has not received a pulse 245 from sensor 175, then counter 252 continues counting pulses 182***b* from multiplier 182. For each of the next two sets of one hundred counts, the millennial counter 253 unloads a set of one hundred counts to the centennial counter 252. After counter 252 has counted two hundred pulses, I=0 for counter 253 and switch 244 closes. If after switch 242 closes and prior to switch 244 closing counter 252 receives a pulse 245 from sensor 175, then all counters 249 to 254 in second counter 400 are reinitialized to the values shown in FIG. 11, any closed switches 240 to 243 are opened, and no supplemental pulse 246 is sent to motor 176. If no pulse 245 has been received by counter 252 prior to the closing of switch 244, then after switch 244 closes counter 252 causes switch 135 to open for a period of time sufficient to prevent at least one pulse produced by counter 183 from reaching stepper motor 176. Consequently, first counter 300 second counter 400, control unit 174, and motor 176 work in tandem to maintain the folding mechanisms in synchronization with the feed roller 17 and to maintain the lines of weakening in the paper strip 87 in synchronization with the folding mechanisms. After switch 244 closes, all counters 249 to 254 are reinitialized to the values shown in FIG. 11 and switches 240 to 244 are opened. Centennial counter 249 again begins counting and the counting cycle by counter 400 is repeated in the manner just described.

The number of pulses counted by counter 400 to advance, retard, or maintain the synchronism of the folding mechanisms with respect to the lines of weakening in the paper can vary as desired. For example, in counter 400 the initialized values of counters 249 to 254 could be I=0, I=6, I=4, I=0, I=1, I=0, respectively.

The number of pulses counted by counter 300 prior to sending a pulse 246 to motor 176 varies depending on the diameter of the feed roller 17 and the fold length. For example, if in TABLE I above the fold length is four inches, in counter 300 counters 183 to 186 are initialized with I=0, I=8, I=4, and I=0, respectively, so that a pulse 246 is produced for each forty eight pulses 182*a* received from multiplier 182.

Control unit 174 includes means for programming counters 183 to 186 and 249 to 254 to desired initialization values. In one embodiment of the invention, such programming means includes a keyboard for inputting into control unit 174 the fold length and diameter of the feed roller. Internal circuitry and/or software determines the proper initialization or I values for counters 183 to 186 and sets the counters 183 to 186 to the proper I values. Similarly, the keyboard is utilized to input the distance between reference points 173*a*—173*b* so that internal circuitry and/or software determines the proper I values for and sets counters 249 to 254.

Figure 7:
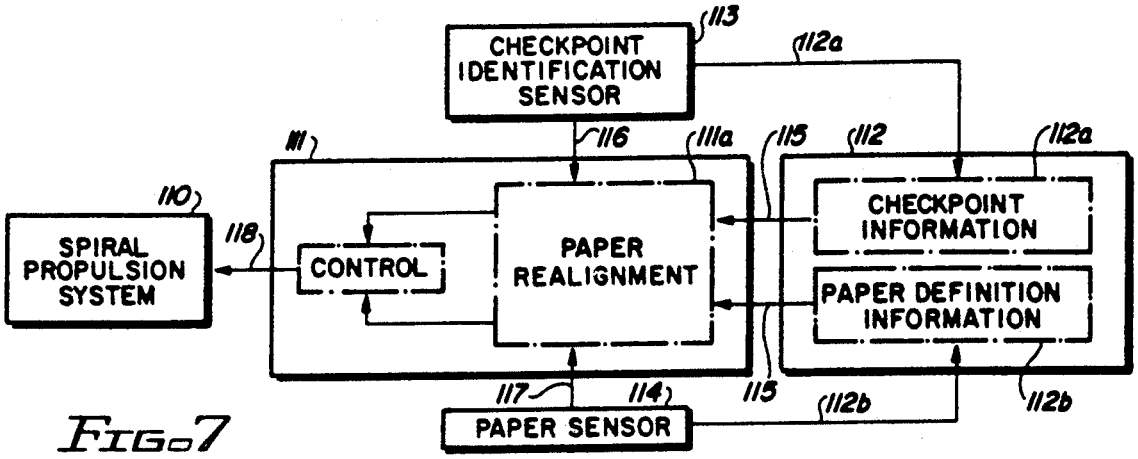
FIG. 7 is a block diagram illustrating an improved folding mechanism guidance system embodying the present invention.
Figure 8:
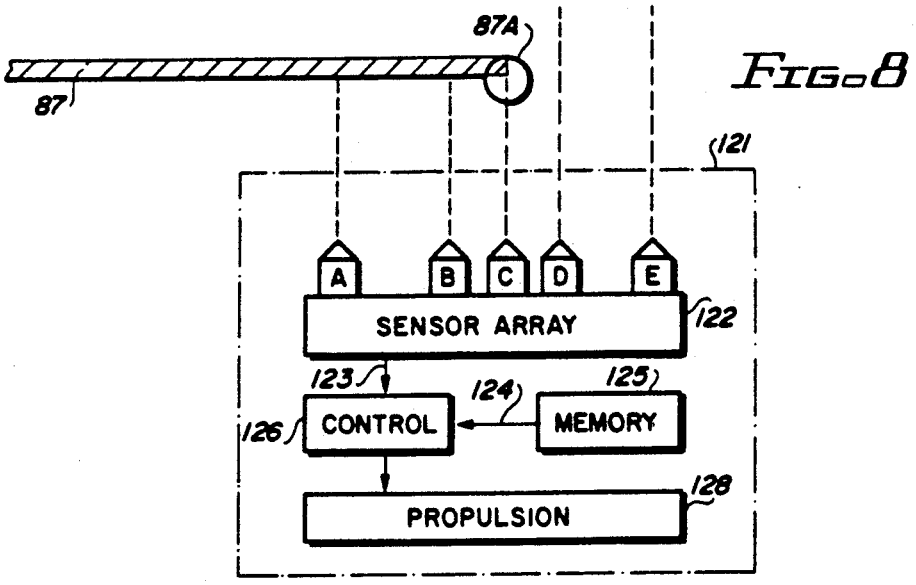
FIG. 8 illustrates a paper checkpoint sensor which is employed in the embodiment of the invention in FIG. 7.
Figure 9:
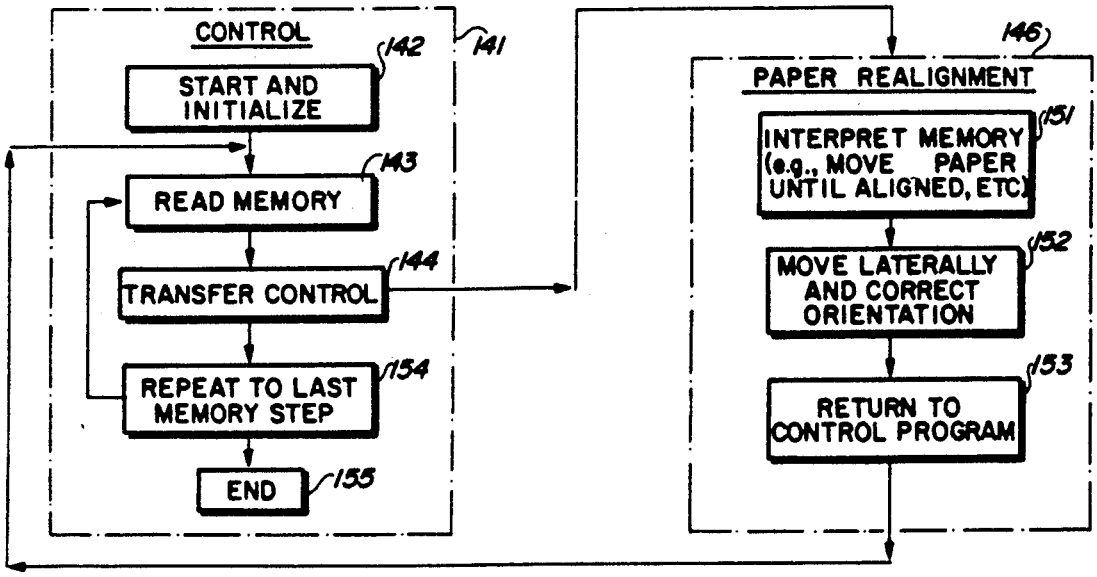
FIG. 9 is a block diagram which illustrates a typical program or logic function utilized in accordance with the embodiment of the invention in FIG. 7.

An automated embodiment of the invention is illustrated in FIGS. 7 to 9. FIG. 7 is a block diagram which illustrates a preferred embodiment of an improved spiral guidance system of the invention, the main components of which are a spiral propulsion system 110, a propulsion system controller 111, and a memory 112. A checkpoint identification sensor 113 and a paper sensor 114 are provided. The checkpoint identification sensor is equivalent to a sensor 175 or sensor 0 and detects reference points 173 along paper strip 87 with respect to the folding mechanisms. For example, the sensor 113 could detect lines of weakening 168, marks 173, or dots 163 imprinted on paper strip 87 in FIG. 4A. The normal distance between each dot 163 is known. Sensor 113 indicates when each dot 163 passes by sensor 113. In this description of the system of FIGS. 7, 8, and 9, it is assumed that apparatus equivalent to that of FIG. 6 is being utilized. As used herein, the distance between a pair of reference marks 173 refers to the shortest distance between a successive pair of reference marks, such reference marks normally being equally spaced along paper strip 87 and lying along a line parallel to the direction of travel of strip 87 through the paper folding apparatus.

Paper sensor 114 is equivalent to sensor 172 and generates signals indicating the speed at which paper strip 87 is input into the spirals and other folding mechanisms.

The memory 112 contains both checkpoint identification information 112*a* and paper definition information 112*b*. The sensor 114 used to provide paper definition information can comprise a sensor 172, can comprise a keyboard which an operator uses to periodically input paper input speed, or can be any other suitable sensor or data input system. After the checkpoint information 112*a* and paper definition information 112*b* are stored in the memory 112, during subsequent operation cycles this information can be recalled from the memory 112 and the recalled information 115 is fed to the controller 111, and used in the paper realignment sub-routine 146 to determine the proper operation of the spirals and other folding mechanism with respect to the speed of the paper. Information from sensors 114, 113 is also directly fed 117, 116 to controller 111. The controller 111 generates control signals 118 which are fed to propulsion system 110. System 110 includes stepper motor 176 and provides the motive power to drive the spirals 42, chute 19, and beaters 41. The spiral propulsion system 110 also includes shaft 23 and the other gear train components transmitting motive power from motor 176 to the spirals 42 and other folding mechanisms.

The spiral propulsion system 110 can be any suitable system for providing motive power to the folding mechanisms in response to signals from control unit 174.

The memory 12 can be any suitable prior art memory unit such as are commonly used in industrial machines, numerical control machines, etc. For example, electromagnetic memories such as magnetic, optical, solid state, etc. or mechanical memories such as paper tape can be used.

An orientation sensor which can be employed in accordance with the presently preferred embodiment of the invention of FIGS. 7 to 9 is illustrated schematically in FIG. 8. The sensor array 122 is mounted on a box 3, 4 or is mounted at any appropriate fixed location on the apparatus of FIGS. 1 and 2. The output 123 of array 122, along with information 124 recalled from the memory 125, is processed in the controller 126 to provide command signals 127 to the spiral propulsion system 128 of the paper folding machine 121. When sensor array 122 comprises a single opto sensor O as illustrated in FIG. 4A, array 122 can be mounted on a box 3, 4 or other movable member in the manner illustrated in FIG. 4A. When sensor array 122 is utilized to locate a reference point or dot 123, array 122 can comprise a plurality of sensors A–E and be mounted at a fixed location on the apparatus of FIGS. 1 and 2.

The sensor array 122 can be a series of mechanically operated switches, ultrasound range detectors or any other suitable sensor which detects the proximity of a selected reference points moving by the sensor array. In FIG. 4A each reference dot 163 and the line of perforation 158 comprise reference points or checkpoints.

FIG. 9 is a block flow diagram which illustrates a typical program or logic function which is executed by the controller 1111 for operating the spirals 42 and other folding mechanisms in synchronization with the feed roller 17 and for compensating for the stretching or contraction of the paper strip 87 as it passes through the folding machine. The basic control program 141 consists of commands to "start and initialize" 142, "read memory" 143 and "transfer control" 144 to the spiral realignment sub-routine 146. The spiral realignment sub-routine 146 consists of commands to "interpret memory" 151 (i.e., determine the adjustment of the stepper motor necessary to maintain synchronization with feed roller or paper) and "move spirals and correct orientation" 152 (i.e., apply motive power to spirals to maintain synchronization with feed roller and paper). Command 152 is followed by "return to control program" 153. The spiral alignment sub-routine 146 is repeated as indicated by the "repeat to last memory step" 154 of the control program 141 followed by an "end" program 155 which completes the execution of the program.

In use, paper strip 87 is fed into the spiral paper folding machine of FIGS. 1, 2 and 6 by roller 17. Sensor 172 generates pulses 181 to control unit 174. Each time unit 174 receives a selected number of pulses, it generates a pulse 246 to stepper motor 176. The pulses 246 to stepper motor 176 cause motor 176 to power the folding mechanisms in synchronization with roller 17. Pulses 245 generated by sensor 175 indicate when strip 87 is stretched or contracted and cause control unit 174 to advance or retard motor 176 to synchronize the folding mechanisms with lines of weakening in strip 87.

Having described my invention in such terms as to enable those skilled in the art to understand and practice it, and having identified the presently preferred embodiments thereof, I claim:

1. In combination with apparatus for producing continuous form stationery by folding a strip of paper along transverse lines of weakening formed therein while said strip of paper moves along a path of travel through said apparatus, said apparatus including a frame, oscillating guide means mounted on said frame for alternately distributing successive ones of said lines of weakening in said strip of paper in substantially opposite directions, dispensing means for feeding said strip of said paper into said guide means at a predetermined velocity, folding means carried on said frame and operatively associated with said oscillating guide means for urging said strip of paper distributed by said guide means into a folded condition, gear train means for transmitting motive power to actuate said oscillating guide means and said folding means, a drive shaft for transmitting motive power to said gear train means actuating said oscillating guide means and folding means, means for transmitting motive power to said dispensing means, power means to drive said means for transmitting motive power to said dispensing means, said guide means, feeding means and folding means moving in synchronous relationship during the operation of said apparatus, the improvement comprising means for rotating said drive shaft at a selected number of revolutions per minute in relation to said velocity at which said dispensing means feeds said strip of paper into said oscillating guide means and in relation to the fold length from one of said lines of weakening to another of said lines of weakening immediately succeeding said one of said folded lines of weakening, said drive shaft rotating means including (a) sensor means for determining said velocity at which said dispensing means feeds said strip of paper into said oscillating guide means and for generating paper velocity signals representing the velocity in units of length per unit of time of said strip of paper directed into said oscillating guide means;

(b) motor means connected to said drive shaft and responsive to said paper velocity signals to (i) provide, independently of said means for transmitting motive power to said dispensing means, the motive power to rotate said drive shaft a selected number of revolutions each time said dispensing means dispenses a portion of said strip of paper having said fold length, (ii) maintain the synchronous relation between said feed roller and said paper distribution means, and (iii) cause said oscillating guide means to oscillate a selected number of times each time said guide means distributes a portion of said strip of paper having said fold length, said motor means including (iv) a first mode of operation to rotate said shaft at a first RPM with respect to said velocity of said strip of paper to fold said strip of paper along said lines of weakening into sections each having a first fold length, (v) a second mode of operation to rotate said shaft at a second RPM with respect to said velocity of said strip of paper to fold said strip of paper along said lines of weakening into sections each having a second fold length, said first RPM differing from said second RPM, said first fold length differing from said second fold length; and, (c) control means to operate said motor means in either of said first and second modes of operation, said control means operating said motor in said first mode of operation by rotating with said motor means said shaft at said first RPM, said control means operating said motor in said second mode of operation by rotating with said motor means said shaft at said second RPM.

2. The apparatus of claim 1 including (a) means for sensing at least a pair of reference points on said strip of paper at a selected point along said path of travel of said strip of paper through said apparatus and for generating reference point paper alignment signals, said reference points being a known distance apart prior to said strip of paper traveling through said apparatus; and, (b) means operatively associated with said motor means and responsive to said reference point alignment signals to (i) determine the operational distance between said reference points when said strip of paper is moving along said path of travel past said selected point;

(ii) compare and determine any deviation between said known distance and said operational distance;

(iii) adjust the rotation of said drive shaft by said motor to compensate for differences between said known distance and said operational distance to synchronize the position of said lines of weakening in said strip of paper with respect to said folding mechanisms.

3. In combination with apparatus for producing continuous form stationery by folding a strip of paper along transverse lines of weakening formed therein while said strip of paper moves along a path of travel through said apparatus, said apparatus including a frame, oscillating guide means mounted on said frame for alternately distributing successive ones of said lines of weakening in said strip of paper in substantially opposite directions, dispensing means for feeding said strip of said paper into said guide means at a predetermined velocity, folding means carried on said frame and operatively associated with said oscillating guide means for urging said strip of paper distributed by said guide means into a folded condition, gear train means for transmitting motive power to actuate said oscillating guide means and said folding means, a drive shaft for transmitting motive power to said gear train means actuating said oscillating guide means and folding means, means for transmitting motive power to said dispensing means, power means to drive said means for transmitting motive power to said dispensing means, said guide means, feeding means and folding means moving in synchronous relationship during the operation of said apparatus, the improvement comprising means for rotating said drive shaft at a selected number of revolutions per minute in relation to said velocity at which said dispensing means feeds said strip of paper into said oscillating guide means in relation to the fold length from one of said lines of weakening to another of said lines of weakening immediately succeeding said one of said folded lines of weakening, said drive shaft rotating means including (a) motor means connected to said drive shaft to (i) provide, independently of said means for transmitting motive power to said dispensing means, the motive power to rotate said drive shaft a selected number of revolutions each time said dispensing means dispenses a portion of said strip of paper having said fold length, (ii) maintain the synchronous relation between said feed roller and said paper distribution means, and (iii) cause said oscillating guide means to oscillate a selected number of times each time said guide means distributes a portion of said strip of paper having said fold length, said motor means including (iv) a first mode of operation to rotate said shaft at a first RPM with respect to said velocity of said strip of paper to fold said strip of paper along said lines of weakening into sections each having a first fold length, (v) a second mode of operation to rotate said shaft at a second RPM with respect to said velocity of said strip of paper to fold said strip of paper along said lines of weakening into sections each having a second fold length, said first RPM differing from said second RPM, said first fold length differing from said second fold length; and, (c) control means to operate said motor means in either of said first and second modes of operation, said control means operating said motor in said first mode of operation by rotating with said motor means said shaft at said first RPM, said control means operating said motor in said second mode of operation by rotating with said motor means said shaft at said second RPM.

4. The apparatus of claim 4 including (a) means for sensing at least a pair of reference points on said strip of paper at a selected point along said path of travel of said strip of paper through said apparatus and for generating reference point paper alignment signals, said reference points being a known distance apart prior to said strip of paper traveling through said apparatus; and, (b) means operatively associated with said motor means and responsive to said reference point alignment signals to (i) determine the operational distance between said reference points when said strip of paper is moving along said path of travel past said selected point;

(ii) compare and determine any deviation between said known distance and said operational distance; and, (iii) adjust the rotation of said drive shaft by said motor to compensate for differences between said known distance and said operational distance to synchronize the position of said lines of weakening in said strip of paper with respect to said folding mechanisms.

5. In combination with apparatus for producing continuous form stationery by folding a strip of paper along transverse lines of weakening formed therein while said strip of paper moves along a path of travel through said apparatus, said apparatus including a frame, oscillating guide means mounted on said frame for alternately distributing successive ones of said lines of weakening in said strip of paper in substantially opposite directions, dispensing means for feeding said strip of said paper into said guide means at a predetermined velocity, folding means carried on said frame and operatively associated with said oscillating guide means for urging said strip of paper distributed by said guide means into a folded condition, gear train means for transmitting motive power to actuate said oscillating guide means and said folding means, a drive shaft for transmitting motive power to said gear train means actuating said oscillating means and folding means, means for transmitting motive power to said dispensing means, power means to drive said means for transmitting motive power to said dispensing means, said guide means, feeding means and folding means moving in synchronous relationship during the operation of said apparatus, the improvement comprising means for rotating said drive shaft at a selected number of revolutions per minute in relation to said velocity at which said dispensing means feeds said strip of paper into said oscillating guide means and in relation to the fold length from one of said lines of weakening to another of said lines of weakening immediately succeeding said one of said folded lines of weakening, said drive shaft rotating means including (a) sensor means for determining said velocity at which said dispensing means feeds said strip of paper into said oscillating guide means and for generating a stream of paper velocity pulse signals representing the velocity in units of length per unit of time of said strip of paper directed into said oscillating guide means;

(b) stepper motor means connected to said drive shaft and responsive to said paper velocity pulse signals to provide, independently of said means for transmitting motive power to said dispensing means, the motive power to rotate said drive shaft a selected number of revolutions each time said dispensing means dispenses a portion of said strip of paper having said fold length, maintain the synchronous relation between said feed roller and said paper distribution means, and cause said oscillating guide means to oscillate a selected number of times each time said guide means distributes a portion of said strip of paper having a length generally equal to said fold length;

said stepper motor means including (i) a first mode of operation to rotate said shaft at a first RPM with respect to said velocity of said strip of paper to fold said strip of paper along said lines of weakening into sections each having a first fold length, (ii) a second mode of operation to rotate said shaft a second RPM with respect to said velocity of said strip of paper to fold said strip of paper into sections each having a second fold length, said first RPM differing from said second RPM, said first fold length differing from said second fold length, and (iii) control means to count said pulse signals received by said motor means, and operate said motor means in either of said first and second modes of operation, said control means operating said motor means in said first mode of operation by rotating with said motor means said shaft through an arc having a selected length each time a first selected number of pulse signals is counted, said control means operating said motor means in said second mode of operation by rotating with said motor means said shaft through said arc each time a second selected number of pulse signals is counted, said second selected number of pulse signals differing from said first selected number of pulse signals.

6. The apparatus of claim 5 including (a) means for sensing at least a pair of reference points on said strip of paper at a selected point along said path of travel of said strip of paper through said apparatus and for generating reference point paper alignment signals, said reference points being a known distance apart prior to said strip of paper traveling through said apparatus; and, (b) means operatively associated with said motor means and responsive to said reference point alignment signals to (i) determine the operational distance between said reference points when said strip of paper is moving along said path of travel past said selected point;

(ii) compare and determine any deviation between said known distance and said operational distance; and, (iii) adjust the rotation of said drive shaft by said motor to compensate for differences between said known distance and said operational distance to synchronize the position of said lines of weakening in said strip of paper with respect to said folding mechanisms.

7. The apparatus of claim 5 including means to increment and decrement said pulse signals produced by said sensor means to advance and retard said drive shaft and said guide means with respect to said velocity of said strip of paper.

* * * * *

UNITED STATES PATENT AND TRADEMARK OFFICE

CERTIFICATE OF CORRECTION

PATENT NO. : 5,015,222

DATED : May 14, 1991

INVENTOR(S) : EARNEST B. BUNCH, III

It is certified that error appears in the above-identified patent and that said Letters Patent is hereby corrected as shown below:

On the title page, delete "Jan. 10, 1989" and insert --Jan. 10, 1990-- as the filing date.

Signed and Sealed this

Seventeenth Day of March, 1992

*Attest:*

HARRY F. MANBECK, JR.

*Attesting Officer*

*Commissioner of Patents and Trademarks*